United States Patent [19]

Yoneda et al.

[11] Patent Number: 5,031,893

[45] Date of Patent: Jul. 16, 1991

[54] DEVICE FOR TURNING OVER PRINTED SHEETS

[75] Inventors: Eiji Yoneda; Kazuhito Murata, both of Hyogo, Japan

[73] Assignee: Kanzaki Paper Mfg. Co., Ltd., Japan

[21] Appl. No.: 426,236

[22] Filed: Oct. 25, 1989

[30] Foreign Application Priority Data

Oct. 28, 1988 [JP] Japan ..... 63-141813[U]

[51] Int. Cl.[5] ..... B65H 29/66

[52] U.S. Cl. ..... 271/65; 271/184; 271/186; 271/200

[58] Field of Search ..... 271/225, 65, 186, 302, 271/303, 184, 185, 188, 200, 902

[56] References Cited

U.S. PATENT DOCUMENTS

| | | | |
|---|---|---|---|
| 850,313 | 4/1907 | North | 271/65 |
| 3,917,256 | 11/1975 | Kubasta | 271/186 X |
| 4,283,048 | 8/1981 | Muller | 271/302 |
| 4,671,503 | 6/1987 | Uemori | 271/65 |
| 4,726,579 | 2/1988 | Kiba et al. | 271/186 |
| 4,884,798 | 12/1989 | Vermaat | 271/186 X |

FOREIGN PATENT DOCUMENTS

| | | | |
|---|---|---|---|
| 0111668 | 6/1984 | European Pat. Off. . | |
| 0274989 | 7/1988 | European Pat. Off. . | |
| 1255114 | 11/1967 | Fed. Rep. of Germany . | |
| 2576296 | 7/1986 | France | 271/186 |
| 27844 | 2/1982 | Japan | 271/186 |
| 236965 | 11/1985 | Japan | 271/65 |

OTHER PUBLICATIONS

Research Disclosures, No. 90, Oct. 1971, p. 59; "Sheet turnover device".

*Primary Examiner*—Robert P. Olszewski
*Assistant Examiner*—Boris Milef
*Attorney, Agent, or Firm*—Stevens, Davis, Miller & Mosher

[57] ABSTRACT

In a printer, a unit for turning over a sheet comprises: a conveying roll provided downstream of a printer head; a top roll and a bottom roll which are rotatably coupled to the front end and the rear end of a swingable link, respectively; and at least one elastic endless belt reeved around the top roll and bottom roll, the swingable link being swingable about the axis of the top roll with the top roll into contact with the conveying roll through the endless belt, and a control mechanism for operating the link so that it is swung down for a first half of a period of time for which a sheet passes through the conveying roll and the top roll, and swung up for the second half.

4 Claims, 2 Drawing Sheets

DEVICE FOR TURNING OVER PRINTED SHEETS

BACKGROUND OF THE INVENTION

This invention relates to a printer, and more particularly to an improvement in a sheet handler for a printer.

In general, a printer discharges printed sheets with the printed surfaces upwards. This sheet discharging method is disadvantageous when a number of sheets are printed, discharged and stacked. In the stack, the sheet printed first is at bottom, and the sheet printed last is at top. Hereinafter, this stacking order will be referred to as a "reverse stacking order", when applicable.

The stacking of printed sheets in the reverse stacking order is not preferable or convenient when, for instance, when a number of sheets are printed with serial or page numbers, as they should be stacked on one another so that the sheet printed first is at top and the sheet printed last is at bottom. In other words, they should be in the forward stacking order instead of the opposite reverse stacking order.

This difficulty can be eliminated by employing a method of discharging the printed sheets from the printer with the printed surfaces downwards. More specifically, in this method, each printed sheet is turned over when discharged from the printer. In order to practice this method, a printer has been proposed in the art which has a U-shaped guide plate downstream of a printed sheet discharging roll in order to turn the printed sheets over. However, this type of printer has a problem in that sometimes the surface of the guide plate is rubbed and a printed sheet is caught making it impossible to smoothly turn the sheet over.

On the other hand, if printed sheets are discharged from the printer with the printed sides downwards, then it is impossible to observe the printed sides, and accordingly it is rather difficult to control print density. Hence, in general, the printed sheets are discharged from the printer with the printed sides upwards.

SUMMARY OF THE INVENTION

Accordingly, an object of this invention is to provide a printer in which the printed sheets are stacked in the forward stacking order, and in which the operation mode may be switched so that, immediately when a printed sheet is discharged, its printed side can be observed.

The foregoing object and other objects of the invention have been achieved by the provision of a printer comprising: a sheet conveying roll provided downstream of a printer head, a top roll and a bottom roll which are rotatably coupled to the front end and the rear end of a swingable link, respectively, in such a manner that the top roll and bottom roll are in parallel with the sheet conveying roll, at least one elastic endless belt reeved around the top roll and bottom roll, the movable link being swingable about the axis of the top roll with the top roll contacting with the sheet conveying roll through the endless belt; and control means for swinging the link down for the first half of a period of time for which a sheet passes through the sheet conveying roll and the top roll, and swinging the link up for the second half.

The printer may further comprise: a sheet passageway switching guide provided between the printer head and a sheet turn-over mechanism, the sheet passageway switching guide being so operated by a control mechanism that, when printed sheets should be stacked with the printed sides downwards, a sheet passed-through the printer head is delivered to the sheet turn-over mechanism, and when printed sheets should be stacked with the printed sides upwards, a sheet passed through the printer head bypasses the sheet turn-over mechanism.

In order to stably turn over a printed sheet, the printer has, instead of a simple U-shaped guide, a sheet turn-over mechanism which turns over a sheet while nipping it. The mechanism is made up of the top and bottom rolls and the endless elastic belt reeved around them. The endless belt, being elastic, is moved at the same speed as the sheet conveying roll while being in contact with about one-third of the cylindrical outer surface of the latter. Thus, the printed sheet is forcibly turned over while being nipped by the sheet conveying roll and the endless belt. This completely prevents the printed sheet from being caught in the printer. The sheet turn-over mechanism operates to change by 180 degrees the direction of movement of a printed sheet passing through the printer head. Therefore, if the printer sheet is allowed, in its entire length, to pass through the sheet turn-over mechanism, then the front end portion of the printed sheet will go deep in the printer; that is, the sheet is laid below the sheet turn-over mechanism, with the result that it is rather difficult to remove the sheet from the printer.

In order to overcome this difficulty, in the printer of the invention, while the printed sheet is being discharged, the bottom roll is raised to leave the sheet conveying roll. Therefore, the front edge of the printed sheet is moved in the printer to a certain position, and then the rear half of the printed sheet is moved by the sheet conveying roll and the top roll in the direction of conveyance of the sheet conveying roll. As a result, the printed sheet is stacked at a position with its printed side downwards where it can be readily taken out of the printer.

When it is necessary to observe the printed side immediately, the sheet passageway switching means provided between the print head and the sheet turn-over mechanism is operated to cause a printed sheet to bypass the sheet turn-over mechanism, so that the printed sheet is discharged with its printed side upwards; that is, the printed side can be read immediately after discharge.

The above objects, advantages and features of the invention will become more apparent from the following detailed description when read in conjunction with the accompanying drawings, in which like parts are designated by like reference numerals or characters.

DETAILED DESCRIPTION OF THE INVENTION

Figure 4:
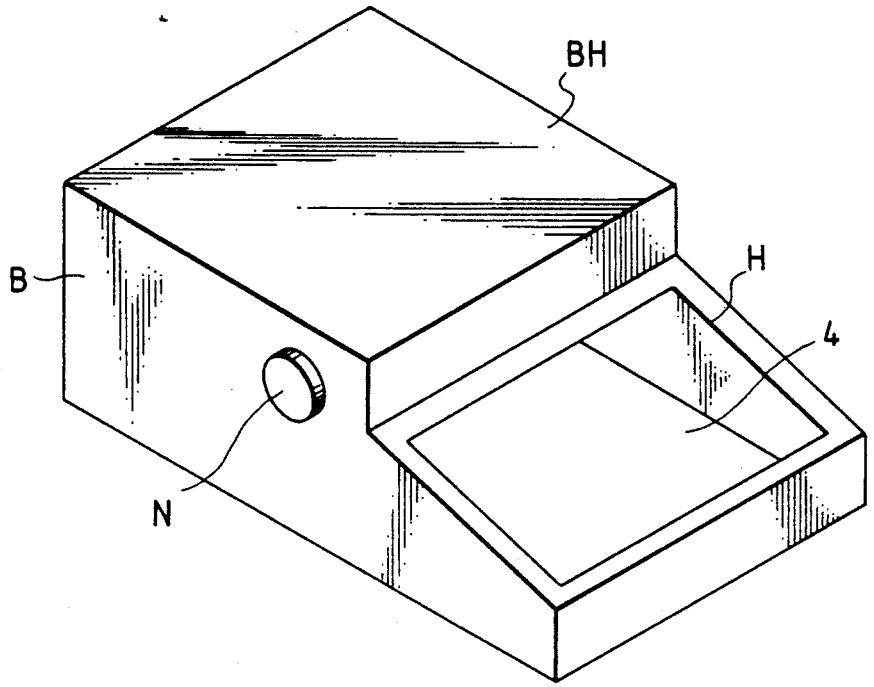
FIG. 4 is an external view of the printer.

One example of a printer according to this invention, is shown in FIG. 4. It includes a printer body B in the upper portion BH of which a printer head and a sheet turn-over mechanism according to the invention are contained. The printer body B has a relatively large opening H in the front part of the upper portion BH. A tray 4 is disposed below the opening H, to receive printed sheets; that is, the printed sheets are stacked on the tray 4. The printed sheets are taken out of the printer through the opening H. The printer has a knob N outside the printer body. When the knob N is turned to a mark "FSO" (forward stacking order), the printed sheets are stacked on the tray 4 in the forward stacking order with the printed sides downwards. When the knob N is set to a mark "WPSU" (with printed side upwards), the printed sheets are stacked with the printed sides upwards so as to permit the operator to observe the printed sides. The knob N is operatively connected to a switching guide discussed below.

Figure 1:
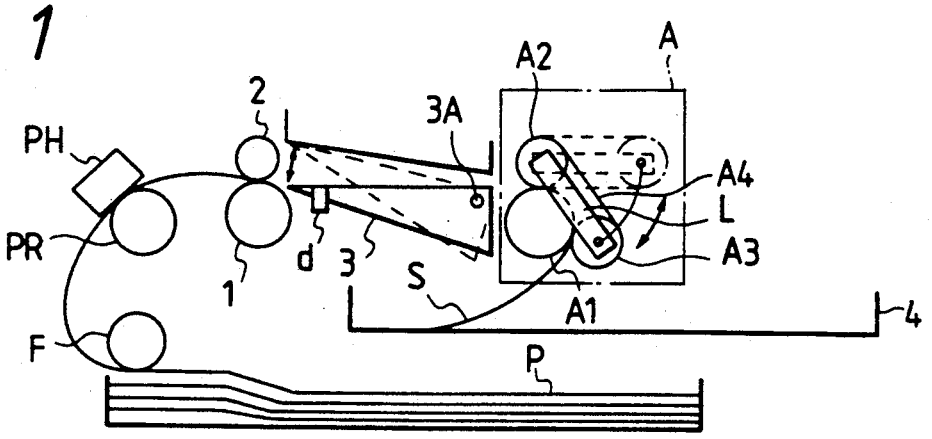
FIG. 1 is a side view showing one example of a printer according to this invention.

FIG. 1 shows the inside of the printer body B. A number of printing sheets P are stacked on a feed tray, and they are delivered by a feed roller F to a printing section one after another. The printing section is made up of a print head PH and a platen roller PR. The print head is, for example, a thermal line head.

Further in FIG. 1, reference numeral 1 designates a sheet conveying roll for discharging a printed sheet; 2, a roll for pushing a printed sheet against the sheet conveying roll 1; and 3, a switching guide provided downstream of the sheet conveying roll 1. The switching guide is swung about a shaft 3A in accordance with the rotation of knob N shown in FIG. 4 so that it takes a first position where its upper surface is held horizontal so that a printed sheet S coming through the sheet conveying roll 1 slides down it, or a second position where the left end of the switching guide is raised; i.e., the switching guide is turned clockwise, so as to allow the printed sheet to flow under it.

The printer further includes: a sheet turn-over unit A. The unit A includes: a sheet conveying roll A1 which is so positioned that a printed sheet sliding down the upper surface of the switching guide 3 is laid over it; a top roll A2 pushed against the sheet conveying roll A1; a bottom roll A3 supported rotatably at one end of a swingable link L to the other end of which the shaft of the top roll A2 is rotatably coupled in such a manner that it is in parallel with the top roll A2; and one or preferably a plurality of width-wise spaced elastic endless belts A4 reeved around the top roll A2 and a bottom roll A3. The top roll A2 is in contact with the sheet conveying roll A1 through the belts A4. The bottom roll A3 is swingable up and down.

Figure 2:
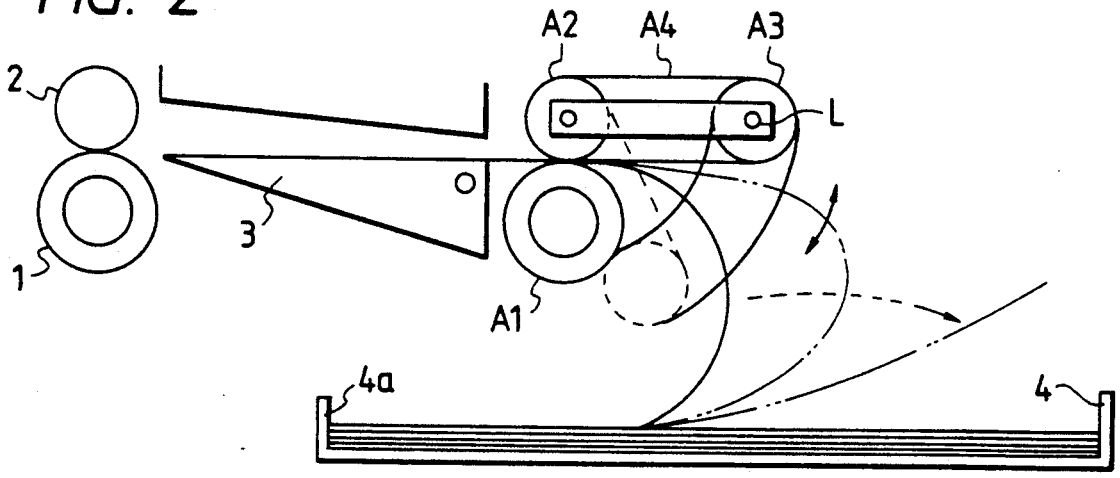
FIG. 2 is a side view showing the printer in which printed sheets are stacked with their printed sides downwards.

When it is required to stack printed sheets in the forward stacking order, the bottom roll A3 is swung down with the link L to bring the endless belts A4 into contact with the sheet conveying roll 1A in such a manner that it covers about one-third of the cylindrical outer surface of the latter roll 1A, and the endless belts A4 are driven at the same speed as the sheet conveying roll 1A. As a result, being held between the sheet conveying roll 1A and the endless belts A4, a printed sheet S is turned over, and its front edge is abutted against the deep end wall **4*a* of the tray 4 (which wall is located to the left in FIG. 1). The time t required for a printed sheet S to reach the deep end wall 4*a* of the tray after passing through the sheet conveying roll 1 is known. Basing on its known time, the bottom roll A3 is moved as shown in FIG. 2**. This will be described in more detail.

Photo-electric detecting means d is disposed downstream of the sheet conveying roll 1 (or on the right side of FIG. 1) and a timer is started in response to a detection signal provided by the photo-electric detecting means d. An electromagnet is operated by a set time lapse signal output of the timer, so as to swing the link L upwards to thereby move the bottom roll A3 to the position indicated by the solid line in FIG. 2. As a result, the rear end portion of the printed sheet S is conveyed to the right of the figure while being held between the sheet conveying roll A1 and the top roll A2, so that the printed sheet S is bent in a substantially U-shape. As the U-shaped part of the printed sheet moves to the right of FIG. 1; that is, as the rear end portion of the printed sheet is conveyed to the right, the rear edge of the printed sheet leaves the sheet conveying roll A1 and the top roll A2, so that the printed sheet is straightened and at the same time laid horizontal in the tray. In this manner, all the printed sheets are successively stacked on the tray with their printed sides downwards.

Figure 3:
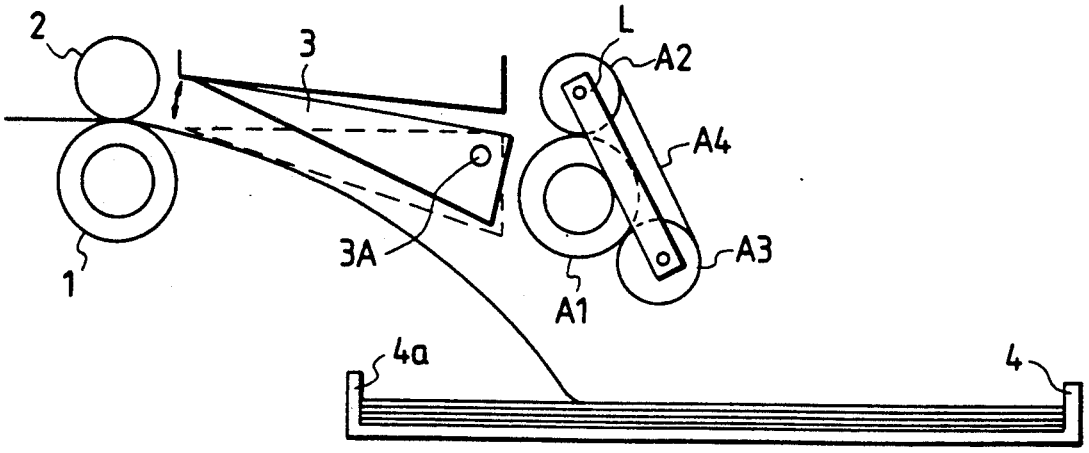
FIG. 3 is a side view showing the printer in which printed sheets are stacked with their printed sides upwards.

When it is required to stack the printed sheets on the tray 4 with their printed sides upwards, as shown in FIG. 3, the left end of the switching guide 3 is raised by operation of knob N; i.e., the switching guide 3 is swung clockwise in the figure so that printed sheets bypass the turn-over mechanism.

Figure 5:
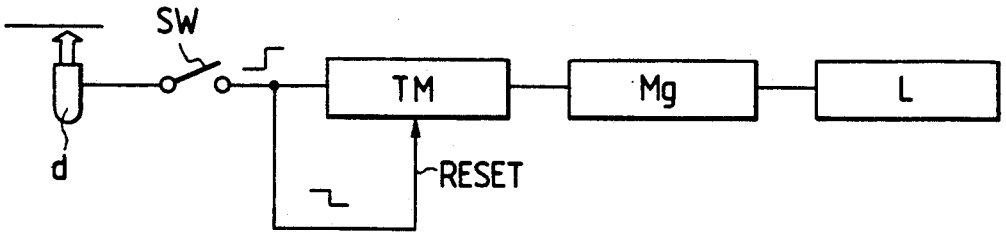
FIG. 5 is a block diagram showing a control system in the printer.

The above-described control system of the printer is shown in FIG. 5. The photo-electric detecting means d is of the reflection type, and is located below the passageway of the printed sheet, to output a high level signal while a printed sheet is passing over it. The output signal of the photoelectric detecting means d is applied to the timer TM through a switch SW which is closed when the knob N (FIG. 4) is set to "FSO". The time TM starts in response to the rise of the output signal of the photo-electric detecting means d, and outputs a high level signal in a predetermined period of time, to energize the electromagnet Mg, which raises the link L. The timer TM is reset by the falling edge of the output signal of the photo-electric detecting means d, so that the electromagnet Mg is deenergized, and the link L is moved down to be ready for receiving the following printed sheet. In the case of stacking the printed sheets with their printed sides upwards, the endless belts 4A are held in contact with the sheet conveying roll A1 in FIGS. 1 through 3.

Thus the control system as shown in FIG. 5 acts as a control means for operating the link L so that it: a) swings down for a first portion of a period of time during which a sheet passes through said sheet conveying rill and said top roll, and b) swings up for a second subsequent portion of said period of time, in so doing the first portion of said period of time is a first half of said period of time and said second portion of said period of time is a second half of said period of time.

Although the switching guide has been described as being operated by knob N, other control mechanisms can also be used to change the position of the switching guide such as electrical switches controlling an electromagnet device.

EFFECTS OF THE INVENTION

As is apparent from the above description, in the printer of the invention, the sheet turn-over mechanism for stacking printed sheets in the forward stacking order is not merely a guide means; that is, in the sheet turn-over mechanism, the printed sheet is moved along the roll so that it is forcibly turned over by rotation of the roll. Therefore, the printed sheet will never be caught in the passageway of a printed sheet and it is positively turned over when discharged from the printer. Furthermore, the two operation modes, namely, the mode of stacking printed sheets with their printed sides upwards, and the mode of stacking printed sheets with their printed side downwards can be switched between one another which greatly improves the utility use of the printer.

While the invention has been described in connection with a preferred embodiment, it will be obvious to those skilled in the art that various changes and modifications may be made therein without departing from the spirit and scope of the invention. Accordingly, the invention is not limited by the foregoing description, but is only limited by the scope of the appended claims.

What is claimed is:

1. A printer comprising:

a printer head;

a sheet turn-over mechanism comprising:

a sheet conveying roll provided downstream of said printer head for conveying a sheet printed by said printer head, a top roll and a bottom roll which are rotatably coupled to the front end and the rear end of a swingable link, respectively, in such a manner that the axes of rotation of said top roll and bottom roll are generally parallel with the axis of rotation of said sheet conveying roll, at least one elastic endless belt reeved around said top roll and bottom roll, said link being swingable about the axis of said top roll with said top roll contacting with said sheet conveying roll through said endless belt; and control means for operating said link so that it: a) swings down for a first portion of a period of time during which a sheet passes through said sheet conveying roll and said top roll, and b) swings up for a second subsequent portion of said period of time, said sheet turn-over mechanism operating to change the direction of movement of a printed sheet passing by said printer head.

2. A printer as in claim 1, further comprising: a sheet passageway switching guide provided between said printer head and said sheet turn-over mechanism, and means for operating said sheet passageway switching guide so that, when printed sheets should be stacked with the printed sides downwards, a sheet passed by said printer head is delivered to said sheet turn-over mechanism, and when printed sheets should be stacked with the printed sides upwards, a sheet passed through said printer head bypasses said sheet turn-over mechanism.

3. A printer as in claim 1, wherein said first portion of said period of time is a first half of said period of time and said second portion of said period of time is a second half of said period of time.

4. A printer as in claim 1, wherein said endless belt, when said link is swung down, is in contact with about one-third of the peripheral surface of said sheet conveying roll.

* * * * *